US008991811B1

(12) United States Patent
Iljima

(10) Patent No.: US 8,991,811 B1
(45) Date of Patent: Mar. 31, 2015

(54) IMAGE RECORDING DEVICE

(71) Applicant: Brother Kogyo Kabushiki Kaisha, Nagoya-shi, Aichi-ken (JP)

(72) Inventor: Shota Iljima, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/227,714

(22) Filed: Mar. 27, 2014

(30) Foreign Application Priority Data

Sep. 30, 2013 (JP) ..... 2013-205992

(51) Int. Cl.
*B65H 1/04* (2006.01)
*B65H 1/08* (2006.01)
*B65H 5/06* (2006.01)

(52) U.S. Cl.
CPC .. *B65H 1/08* (2013.01); *B65H 5/06* (2013.01); *B65H 1/04* (2013.01)
USPC ..... 271/9.09; 271/162; 399/124; 399/392

(58) Field of Classification Search
USPC ..... 271/9.09, 162; 399/124, 125, 392
See application file for complete search history.

(56) References Cited

U.S. PATENT DOCUMENTS

| | | | | |
|---|---|---|---|---|
| 7,369,789 | B2 * | 5/2008 | Lee et al. | 399/90 |
| 7,637,501 | B2 * | 12/2009 | Akiyama et al. | 271/273 |
| 8,095,039 | B2 * | 1/2012 | Yamauchi | 399/121 |
| 8,315,539 | B2 * | 11/2012 | Uehara | 399/124 |
| 2011/0049791 | A1 * | 3/2011 | Osakabe | 271/225 |
| 2012/0141158 | A1 * | 6/2012 | Yamauchi | 399/110 |

FOREIGN PATENT DOCUMENTS

JP 8-113379 H 5/1996

* cited by examiner

*Primary Examiner* — Patrick Cicchino
(74) *Attorney, Agent, or Firm* — Merchant & Gould PC

(57) ABSTRACT

An image recording device having a first housing, a second housing, and a support tray adjacent to a first side of the second housing and a first side of the first housing. The support tray is pivotably connected to the first housing and is movable between a third state and a fourth state and a retainer portion connecting the support tray to the second housing in a first state and a second state.

13 Claims, 9 Drawing Sheets

IMAGE RECORDING DEVICE

CROSS-REFERENCE TO RELATED APPLICATION

This application claims priority from Japanese Patent Application No. 2013-205992, filed on Sep. 30, 2013, which is incorporated herein by reference in its entirety.

TECHNICAL FIELD

Aspects described herein relate to an image recording device that records an image on a sheet conveyed in a conveyance path defined inside the image recording device.

BACKGROUND

An example image recording device has a conveyance path defined inside its housing and is configured to record an image onto a sheet that is being conveyed along the conveyance path. Some image recording devices include a manual feed tray configured to guide a sheet into the conveyance path.

One image recording device includes a manual feed tray and a scanner unit in which the manual feed tray is disposed at a side surface of an image forming section of the image recording device. In this example, the scanner unit is disposed above the image forming section. The manual feed tray is configured to pivot between a position where the scanner unit tilts upward from the side surface of the image forming section and exposes a manual feed port and a position where the scanner unit closes the manual feed port.

SUMMARY

Some embodiments of the present disclosure provide for an image recording device comprising a first housing having a sheet conveyance path, a second housing disposed above the first housing to pivot about a first pivot axis, the second housing being movable between a first state in which a lower surface of the second housing is generally adjacent to an upper surface of the first housing and a second state in which the lower surface of the second housing is angled relative to the upper surface of the first housing. The image recording device further comprises a support tray adjacent to a first side of the second housing and the first side of the first housing and pivotably connected to the first housing, the support tray being movable between a third state and a fourth state, the support tray communicating with the sheet conveyance path, and a retainer portion connecting the support tray to the second housing in the first state and the second state.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
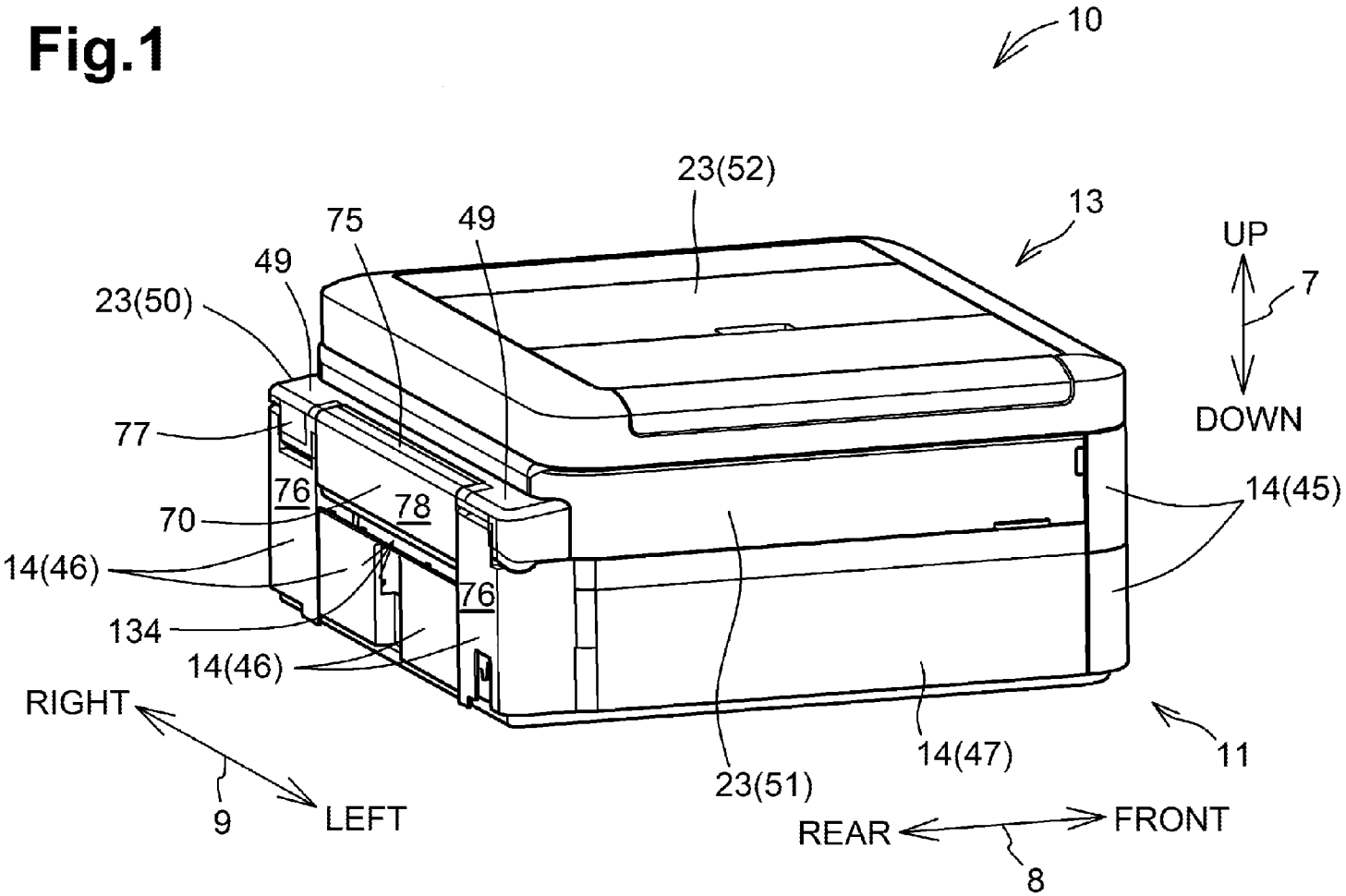
FIG. 1 is a perspective view depicting a multifunction device in an illustrative embodiment according to one or more aspects of the disclosure, wherein a scanner housing is in a first state and a manual feed tray is in a third state.

An illustrative embodiment according to one or more aspects will be described below with reference to the accompanying drawings. The illustrative embodiment described below is merely an example. Various changes, arrangements and modifications may be applied therein without departing from the spirit and scope of the disclosure. In the description below, an up-down direction 7 is defined with reference to an orientation of a multifunction device 10 that is disposed in which it is intended to be used (e.g., an orientation depicted in FIG. 1). A side of the multifunction device 10, in which a support tray, such as a manual feed tray 70 is disposed, is defined as the back of the multifunction device 10. A front-rear direction 8 is defined with reference to the back of the multifunction device 10. A right-left direction 9 is defined with respect to the multifunction device 10 as viewed from its front that is opposite to the back of the multifunction device 10.

[Overall Configuration of Multifunction Device 10]

As depicted in the example of FIG. 1, the multifunction device 10 (as an example of an image recording device) has substantially a rectangular parallelepiped shape and a lower height. The multifunction device 10 includes a scanner unit 13 at its upper portion and a printer unit 11 at its lower portion. The printer unit 11 includes a printer housing 14 (as an example of a first housing) having substantially a rectangular parallelepiped shape. The scanner unit 13 includes a scanner housing 23 (as an example of a second housing) having substantially a rectangular parallelepiped shape.

The multifunction device 10 has various functions, for example, a facsimile function and a printing function. The multifunction device 10 has a function of recording an image onto one side of a recording sheet 12 (see FIG. 4) using an inkjet method, as the printing function. In other embodiments, for example, the multifunction device 10 may be configured to record an image onto each side of a recording sheet 12. The multifunction device 10 further has a function of recording an image onto a surface of a recording medium (as an example of a recording medium), e.g., a CD-ROM or a DVD-ROM having a thickness greater than the recording sheet 12, supported by a medium tray 110 (see FIG. 4).

[Feed Tray 20]

Figure 4:
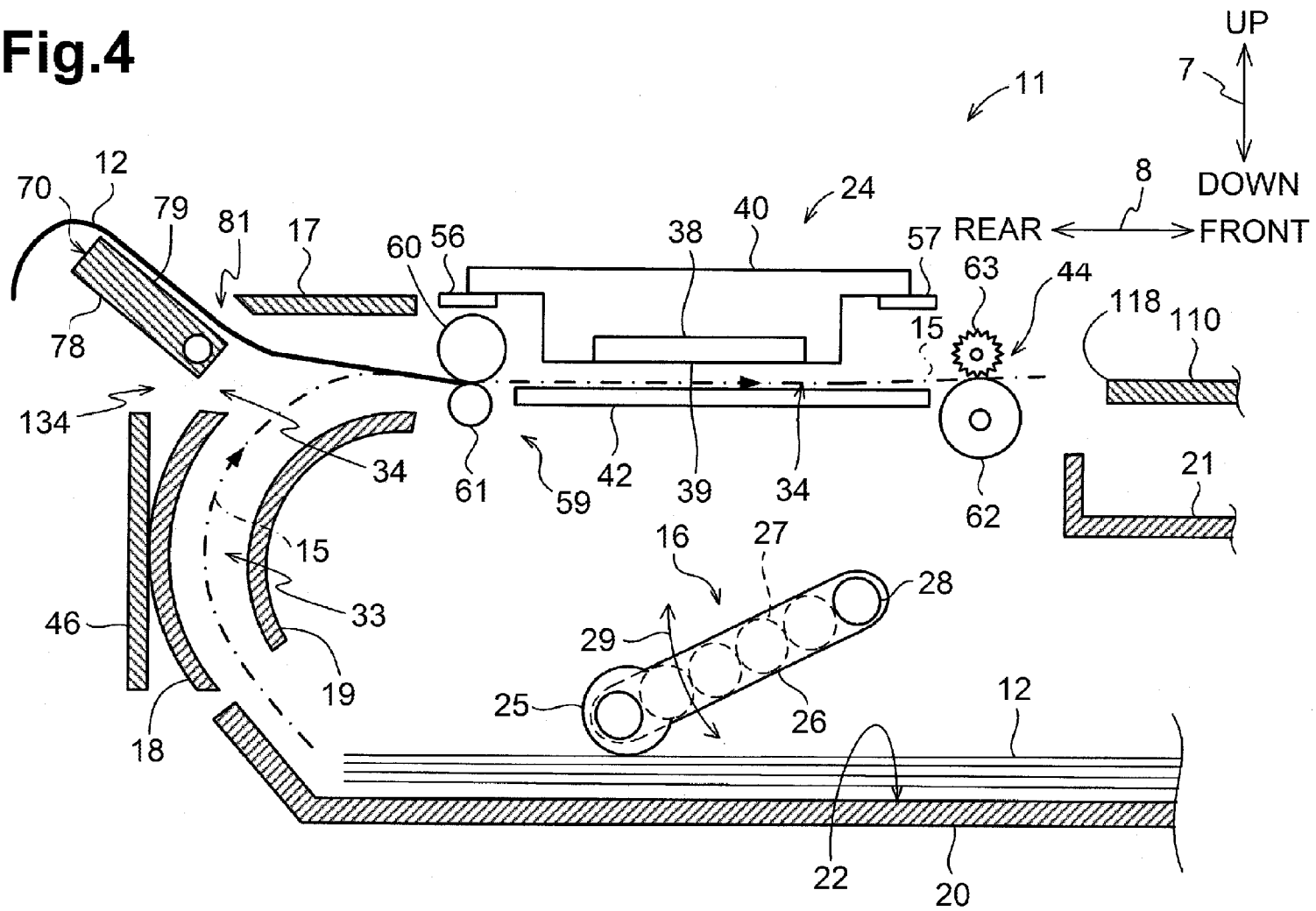
FIG. 4 is a longitudinal sectional view depicting an internal configuration of a printer unit in the illustrative embodiment according to one or more aspects of the disclosure.

As depicted in the example of FIG. 4, the printer unit 11 includes a feed tray 20 at its lower portion. The feed tray 20 is configured to move in the front-rear direction 8 to be removed from and inserted into the printer housing 14. The feed tray 20 has a box shape with its top opened. The feed tray 20 is configured to support one or more recording sheets 12 stacked on a bottom plate 22 thereof. A discharge tray 21 is supported at an upper front position with respect to the feed tray 20. The one or more recording sheets 12 on which images have been recorded by a recording section 24 are discharged onto an upper surface of the discharge tray 21.

[Feeder Unit 16]

As depicted in the example of FIG. 4, the feeding section 16 is disposed above the bottom plate 22 of the feed tray 20 positioned in the printer housing 14. The feeding section 16 includes a feed roller 25, a feed arm 26, and a power transmission mechanism 27. The feed roller 25 is rotatably supported at a distal end portion of the feed arm 26. The feed arm 26 is swingably supported by a support shaft 28 disposed at a proximal end portion of the feed arm 26. The feed arm 26 is swingable on the support shaft 28 in directions of an arrow 29. With this configuration, the feed rollers 25 is allowed to come into contact with and move away from the bottom plate 22 of the feed tray 20 or the one or more recording sheets 12 supported by the feed tray 20.

The feed roller 25 rotates by transmission of a driving force of a conveyor motor (not depicted) by the power transmission mechanism 27 including gears that are engaged with one another. With the rotation of the feed roller 25, an uppermost recording sheet 12, which is in contact with the feed roller 25, of the one or more recording sheets 12 placed on the bottom plate 22 of the feed tray 20 is fed into a curved path 33. In other embodiments, for example, the feed roller 25 may be configured to rotate by application of a driving force from another motor provided apart from the conveyor motor.

[Curved Path 33 and Straight Path 34]

As depicted in the example of FIG. 4, the curved path 33 and a straight path 34 (as an example of a conveyance path) extend from a rear end of the feed tray 20 inside the printer housing 14. The curved path 33 extends curvedly upward from the rear end of the feed tray 20. The straight path 34 extends in the front-rear direction 8.

The curved path 33 is defined by an outer guide member 18 and an inner guide member 19 that face each other and be spaced apart from each other at a predetermined interval. The straight path 34 is defined by the recording section 24 and a platen 42 at a position where the recording section 24 is disposed. The recording section 24 and the platen 42 face each other and are spaced apart from each other at a predetermined interval.

The one or more recording sheets 12 supported by the feed tray 20 are fed, one by one, into the curved path 33 by the feed roller 25 and conveyed along a conveyance direction 15, which is indicated by an a dot and dashed line in FIG. 4, in the curved path 33 and the straight path 34. The medium tray 110 is inserted into the straight path 34 via an opening (not depicted) defined in the front of the printer housing 14 and is conveyed along the straight path 34 in the front-rear direction 8. That is, the curved path 33 allows the recording sheet 12 to pass therethrough and the straight path 34 allows the recording sheet 12 and the medium tray 110 to pass therethrough.

[Recording Section 24]

As depicted in the example of FIG. 4, the recording section 24 defines an upper portion of the straight path 34 inside the printer housing 14. The platen 42 is disposed below the recording section 24 and face the recording section 24. The platen 42 is configured to support a recording sheet 12 being conveyed in the straight path 34.

As depicted in the example of FIG. 4, the recording section 24 includes a carriage 40 and a recording head 38. The carriage 40 is supported by guide rails 56 and 57 such that the carriage 40 is allowed to reciprocate in the right-left direction 9. The guide rails 56 and 57 are spaced apart from each other in the front-rear direction 8. The recording head 38 is mounted on the carriage 40. The recording head 38 is configured to be supplied with ink from one or more ink cartridges (not depicted). The recording head 38 has nozzles 39 defined in its lower surface. The recording head 38 ejects ink droplets from the nozzles 39 toward the platen 42 while the carriage 40 reciprocates in the right-left direction 9. Thus, an image is recorded on the recording sheet 12 being conveyed in the conveyance direction 15 and supported by the platen 42 or on a recording medium carried by the medium tray 110.

[Conveyor Roller Pair 59 and Discharge Roller Pair 44]

As depicted in the example of FIG. 4, a conveyor roller pair 59 is disposed upstream of the recording section 24 in the straight path 34 with respect to the conveyance direction 15. A discharge roller pair 44 is disposed downstream of the recording section 24 in the straight path 34 with respect to the conveyance direction 15. The conveyor roller pair 59 includes a conveyor roller 60 and a pinch roller 61. The pinch roller 61 is urged toward the conveyor roller 60 by an elastic member (not depicted). The conveyor roller 60 and the pinch roller 61 are in contact with each other and are configured to pinch a recording sheet 12 therebetween. The discharge roller pair 44 includes a discharge roller 62 and a spur 63. The discharge roller 62 is urged toward the spur 63 by an elastic member (not depicted). The discharge roller 62 and the spur 63 are in contact with each other and are configured to pinch a recording sheet 12 therebetween.

The conveyor roller pair 59 and the discharge roller pair 44 are further configured to pinch the medium tray 110 therebetween as well as the recording sheet 12. The pinch roller 61 and the discharge roller 62, which are lower rollers of the respective roller pairs 59 and 44, are configured to move downward to pinch the medium tray 110 in each of the roller pairs 59 and 44. The platen 42 is also configured to move downward to a position lower than the position of the medium tray 110 being conveyed in the straight path 34. The movement of the pinch roller 61, the discharge roller 62, and the platen 42 in the up-down direction 7 is implemented by a known mechanism, e.g., a mechanism using a linear motor. In other embodiments, for example, the pinch roller 61 and the discharge roller 62 may be configured to move downward against the urging force of the elastic members in response to contact with the medium tray 110 that is inserted or conveyed rearward.

The conveyor roller 60 and the discharge roller 62 are configured to rotate in a normal direction by the transmission of the driving force from the conveyor motor (not depicted) that rotates in a normal direction. The conveyor roller 60 and the discharge roller 62 are configured to rotate in a reverse direction by the transmission of the driving force from the conveyor motor that rotates in a reverse direction. The conveyor roller pair 59 and the discharge roller pair 44 are configured to convey the recording sheet 12 or the medium tray 110 pinched therebetween along the straight path 34 in the conveyance direction 15 when the conveyor roller 60 and the discharge roller 62 rotate in the normal direction. The conveyor roller pair 59 and the discharge roller pair 44 are configured to convey the recording sheet 12 or the medium tray 110 pinched therebetween along the straight path 34 in a direction opposite to the conveyance direction 15 when the conveyor roller 60 and the discharge roller 62 rotate in the reverse direction.

[Image Recording on Recording Sheet 12 or Recording Medium]

Hereinafter, image recording performed on a recording sheet 12 supported by the feed tray 20 will be described. As depicted in FIG. 4, with the rotation of the feed roller 25, one or more recording sheets 12 supported by the feed tray 20 are fed, one by one, into the curved path 33. As the recording sheet 12 fed into the curved path 33 is pinched by the conveyor roller pair 59 disposed in the straight path 34, the recording sheet 12 is further conveyed to the platen 42 in the conveyance direction 15. Then, the recording section 24 records an image onto the recording sheet 12 supported by the platen 42. The recording sheet 12 on which the image has been recorded is further conveyed by the discharge roller pair 44 in the conveyance direction 15 and then is discharged onto the discharge tray 21.

Image recording performed on a recording sheet 12 supported by the manual feed tray 70 will be described. As depicted in FIG. 4, a recording sheet 12 is supported by the manual feed tray 70 with its leading edge being in contact with the conveyor roller pair 59. As the conveyor roller 60 rotates in the normal direction in this state, the recording sheet 12 is conveyed to the platen 42 in the conveyance direction 15. Then, the recording section 24 records an image onto the recording sheet 12 supported by the platen 42. The recording sheet 12 on which the image has been recorded is further conveyed by the discharge roller pair 44 in the conveyance direction 15 and then is discharged onto the discharge tray 21.

Image recording performed on a recording medium carried by the medium tray 110 will be described. First, the pinch roller 61, the discharge roller 62, and the platen 42 are moved downward in response to a user's operation performed on an operation portion (not depicted). In this state, as depicted in FIG. 4, the medium tray 110 carrying a recording medium is inserted into the straight path 34 via the opening (not depicted) defined in the front of the printer unit 11. The medium tray 110 is inserted into at least a position where the medium tray 110 is pinched by the discharge roller pair 44.

Then, as the discharge roller 62 and the conveyor roller 60 rotate in the reverse direction, the medium tray 110 is conveyed rearward. The medium tray 110 is conveyed to a position where the recording medium carried by the medium tray 110 is located behind the recording section 24. At that time, an end portion 118 of the medium tray 110 protrudes from a rear wall 46 of the printer housing 14 via an opening 134 defined in the rear wall 46. The end portion 118 is first inserted into the straight path 34 when the medium tray 110 is inserted.

In this state, the rotating direction of the conveyor motor is changed to the reverse direction from the normal direction. Thus, the driving force transmitted to the conveyor roller 60 and the discharge roller 62 from the conveyor motor is changed in accordance with the change of the rotating direction. Therefore, the medium tray 110 is conveyed forward and the recording medium carried by the medium tray 110 passes under the recording section 24. While the recording medium passes under the recording section 24, the recording section 24 records an image onto the recording medium. The medium tray 110 carrying the recording medium on which the image has been recorded is discharged to the outside via the opening (not depicted) defined in the front of the printer unit 11.

[Printer Housing 14]

As depicted in the example of FIG. 1, the printer housing 14 includes a front wall 45, the rear wall 46 (as an example of a rear wall of the first housing), and a pair of side walls 47. The rear wall 46 is opposite to the front wall 45 and is disposed behind the front wall 45. One side wall 47 connects one of right and left ends of the front wall 45 and one of right and left ends of the rear wall 46 each other and the other side wall 47 connects the other of the right and left ends of the front wall 45 and the other of the right and left ends of the rear wall 46 each other.

Figure 5:
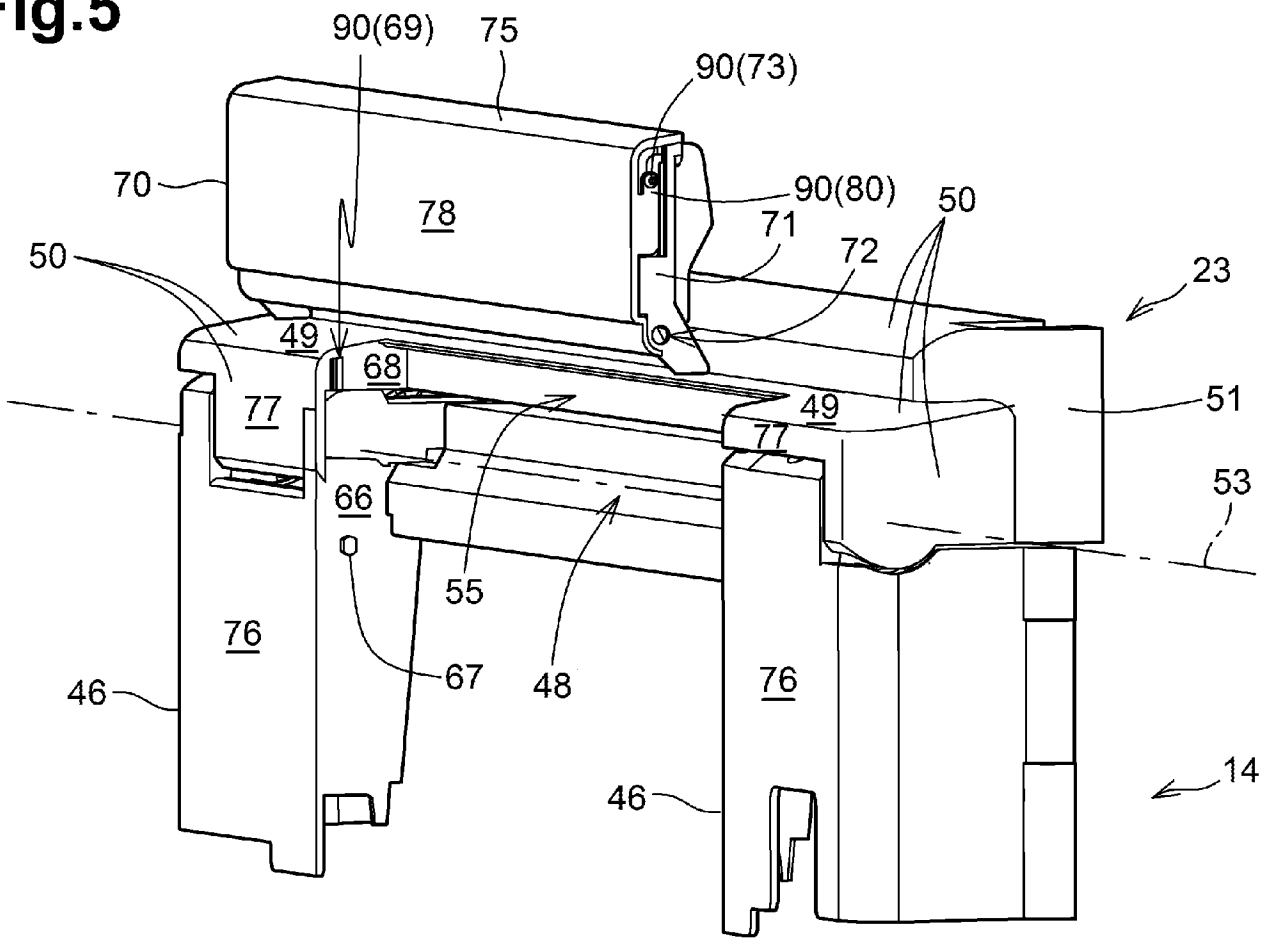
FIG. 5 is a rear perspective view depicting a manual feed tray, a scanner housing, and a printer housing in the illustrative embodiment according to one or more aspects of the disclosure.
Figure 6:
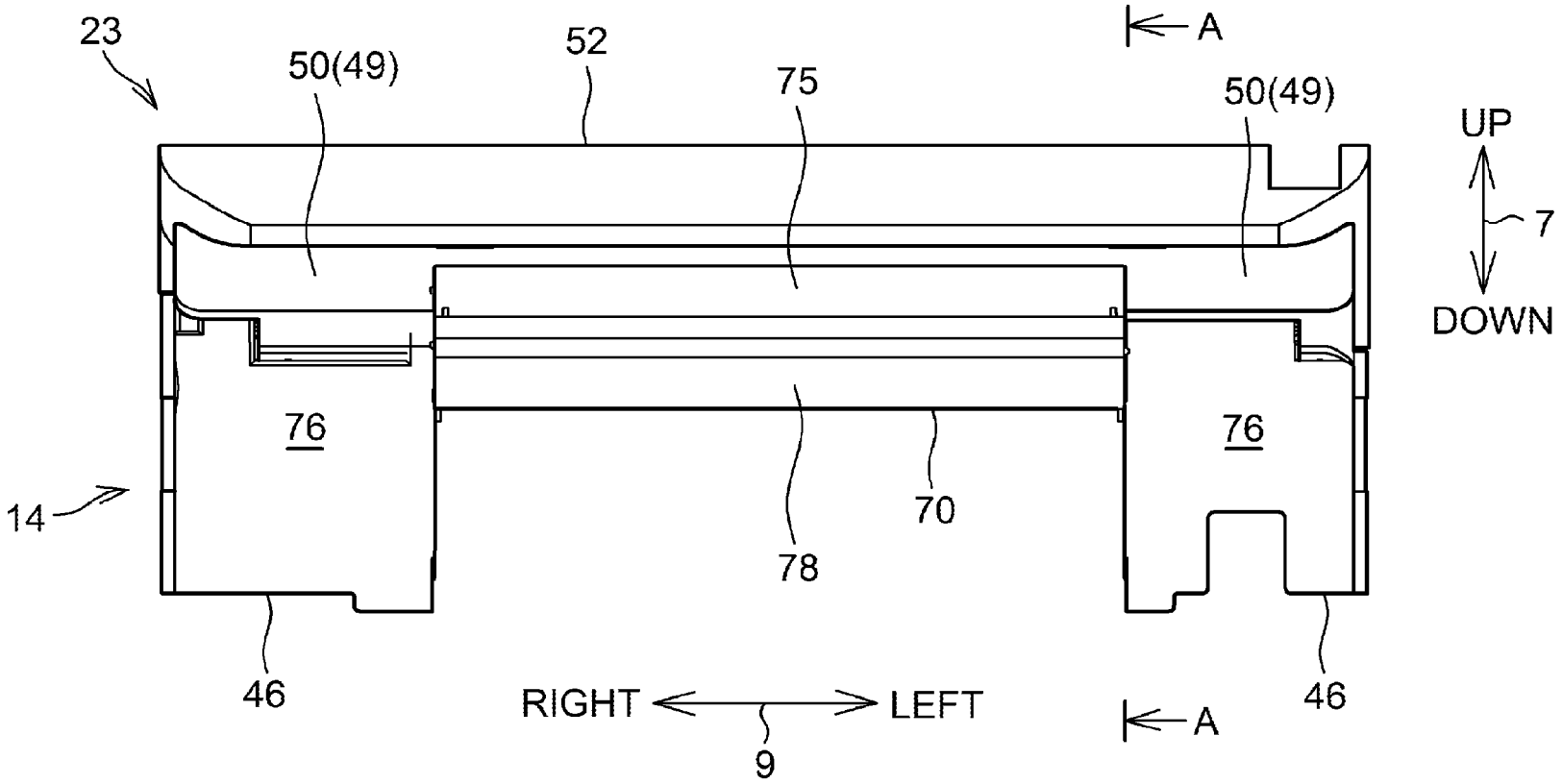
FIG. 6 is an upper rear perspective view depicting the manual feed tray, the scanner housing, and the printer housing in the illustrative embodiment according to one or more aspects of the disclosure.

As depicted in the example of FIG. 5, the rear wall 46 has a first recessed portion 48 at a middle portion thereof in the right-left direction 9. The first recessed portion 48 is recessed toward the front. The first recessed portion 48 is configured to accommodate therein a portion (e.g., a lower portion) of the manual feed tray 70 (see FIG. 1). A dimension of the first recessed portion 48 in the right-left direction 9 is substantially the same as a dimension of the manual feed tray 70 in the right-left direction 9. A depth (e.g., a dimension in the front-rear direction 8) of the first recessed portion 48 is substantially the same as a thickness of the manual feed tray 70 in the front-rear direction 8. The first recessed portion 48 extends in the up-down direction 7 from an upper surface of the rear wall 46 to a position that is lower than a position of a lower end of the manual feed tray 70 positioned in the first recessed portion 48.

A pair of side surfaces 66 defines the first recessed portion 48 with facing each other. A protrusion 67 (as an example of a second shaft) protrudes from each of the side surfaces 66 toward the opposite one of the side surface 66. That is, the protrusion 67 extends in the right-left direction 9.

[Scanner Housing 23]

As depicted in the example of FIG. 1, the scanner housing 23 is disposed above the printer housing 14. A dimension of the scanner housing 23 in the front-rear direction 8 is substantially the same as a dimension of the printer housing 14 in the front-rear direction 8 and a dimension of the scanner housing 23 in the right-left direction 9 is substantially the same as a dimension of the printer housing 14 in the right-left direction 9. Therefore, while the scanner housing 23 is disposed above the printer housing 24, the printer housing 14 and the scanner housing 23 integrally defines substantially a rectangular parallelepiped outer shape of the multifunction device 10.

A reading mechanism (not depicted) is disposed in the scanner housing 23. The reading mechanism includes a platen glass (not depicted) configured to support a document and an image sensor (not depicted) configured to read the document supported on the platen glass. The scanner housing 23 includes a rear wall 50 (as an example of a rear wall of the second housing), a pair of side walls 51, and a pivotable cover 52. The side walls 51 extend forward from right and left ends, respectively, of the rear wall 50.

The rear wall 50 and the pair of side walls 51 support the platen glass by their upper end portions. The image sensor is disposed below the platen glass, that is, a space defined by the rear wall 50 and the side walls 51.

The pivotable cover 52 is disposed above the rear wall 50 and the side walls 51. The pivotable cover 52 is supported by the rear wall 50 at a rear end portion of the pivotable cover 52 and is supported by the side walls 51 at right and left end portions of the pivotable cover 52. The pivotable cover 52 is coupled on the rear wall 50 so as to be pivotable on a rotational axis extending along the right-left direction 9. With this configuration, the pivotable cover 52 is configured to pivot between a position where the pivotable cover 52 covers the platen glass from above (see FIG. 1) and a position where the pivotable cover 52 exposes the platen glass (not depicted). While the platen glass is exposed, a document is placed on the platen glass. The document is placed on the platen glass with its surface having an image facing down. After the document is placed on the platen glass in such a manner, the pivotable cover 52 is brought into the state where the pivotable cover 52 covers the platen glass from above. Then, the image that has been recorded on the document is read by the image sensor.

The scanner housing 23 is coupled on the printer housing 14 at the rear wall 46 of the printer housing 14. The scanner housing 23 is configured to be pivotable on a rotational axis (see FIGS. 5, 7, 8, and 9) extending along the right-left direction 9. More specifically, the scanner housing 23 includes protrusions (not depicted) (as an example of a first shaft) extending from respective positions at which a rotational axis 53 passes in the right-left direction 9. The printer housing 14 has openings (not depicted) in the rear wall 46. The scanner housing 23 is coupled on the printer housing 14 while the protrusions of the scanner housing 23 are disposed in the respective openings (not depicted) by insertion. With this configuration, the scanner housing 23 is configured to pivot on the rotational axis 53 that is the central axis of the protrusions. The protrusions of the scanner housing 23 are disposed at respective positions higher than the protrusions 67. In other embodiments, for example, the printer housing 14 may include such protrusions and the scanner housing 23 may have such openings therein.

Figure 3:
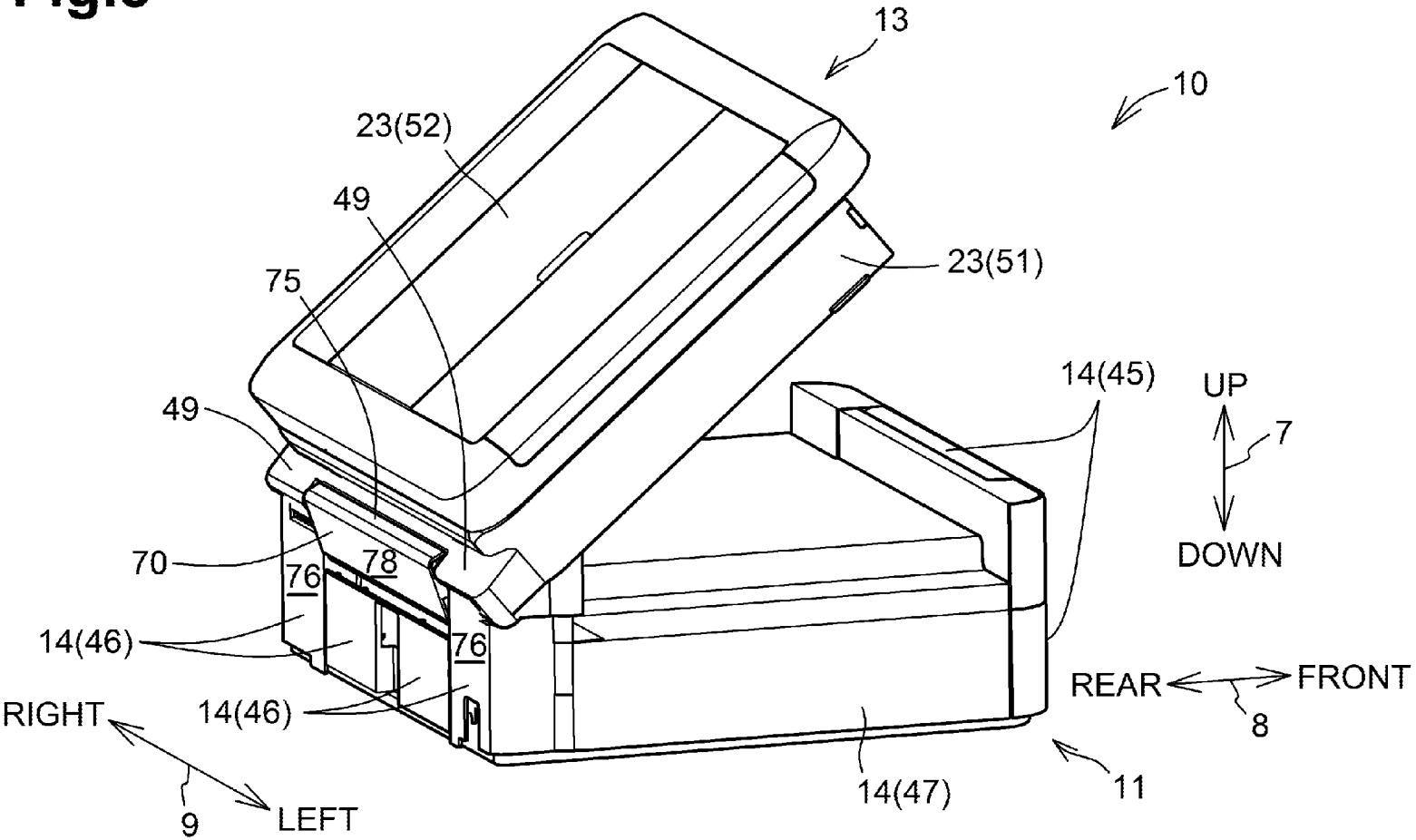
FIG. 3 is a perspective view depicting the multifunction device in the illustrative embodiment according to one or more aspects of the disclosure, wherein the scanner housing is in a second state.
Figure 9:
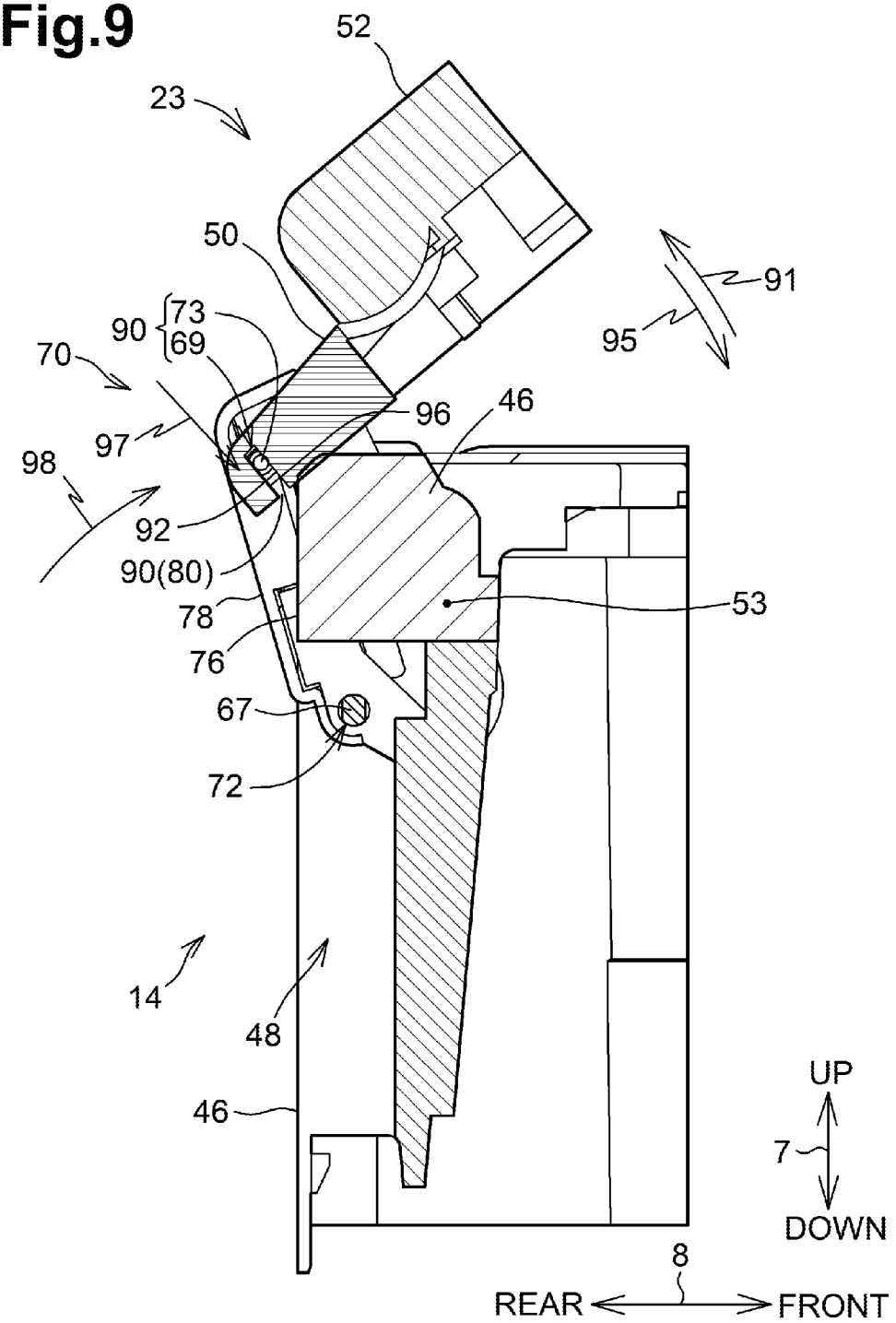
FIG. 9 is a sectional view taken along line A-A of FIG. 6 in the illustrative embodiment according to one or more aspects of the disclosure, wherein the scanner housing is in the second state.

With the configuration described above, the scanner housing 23 is rotatable in directions of arrows 91 and 95 depicted in the example of FIG. 9. Thus, the scanner housing 23 is configured to be changed between the first state depicted in FIG. 1 and the second state depicted in FIG. 3. In the first state, a lower surface of a front end portion of the pivotable cover 52 in the scanner housing 23 is in contact with an upper surface of the front wall 45 of the printer housing 14 and lower surfaces of the side walls 51 of the scanner housing 23 are in contact with upper surfaces of the side walls 47 of the printer housing 14, respectively. Thus, the scanner housing 23 in the first state covers the upper portion of the printer housing 14. The scanner housing 23 in the first state covers the upper portion of the printer housing 14 partially or completely. In the second state, the front end portion and the side walls 51 of the pivotable cover 52 are located distant from the front wall 45 and the side walls 47 of the printer housing 14. Thus, the scanner housing 23 in the second state exposes the upper portion of the printer housing 14.

As depicted in the example of FIG. 5, the rear wall 50 has a second recessed portion 55 therein. The second recessed portion 55 is recessed toward the front from a rear end of the rear wall 50. The second recessed portion 55 is configured to accommodate therein a portion (e.g., an upper portion) of the manual feed tray 70 (see FIG. 1). A dimension of the second recessed portion 55 in the right-left direction 9 is substantially the same as a dimension of the manual feed tray 70 in the right-left direction 9. A depth of the second recessed portion 55 (e.g., a dimension in the front-rear direction 8) is substantially the same as a thickness of the manual feed tray 70 in the front-rear direction 8. The second recessed portion 55 extends in the front-rear direction 8 between an upper surface 49 and a lower surface (not depicted) of the rear wall 50. The second recessed portion 55 is contiguous to the first recessed portion 48 in the front-rear direction 7.

A pair of side surfaces 68 defines the second recessed portion 55. Each side surface 68 has a slit 69 extending in the up-down direction 7 in the state where the scanner housing 23 is in the first state.

[Manual Feed Tray 70]

As depicted in the example of FIG. 1, a manual feed tray 70 is disposed at a rear portion of the printer unit 11. The manual feed tray 70 has a thin flat plate shape. As depicted in FIG. 4, the manual feed tray 70 is disposed at a position higher than the straight path 34.

As depicted in the example of FIG. 5, the manual feed tray 70 has an opening 72 in a lower end portion of each of right and left side surfaces 71.

The manual feed tray 70 is positioned in the first recessed portion 48 and the second recessed portion 55 while the right and left side surfaces 71 of the manual feed tray 70 face the respective side surfaces 66 of the printer housing 14 and the respective side surfaces 68 of the scanner housing 23. In this state, the protrusions 67 are disposed in the respective openings 72.

Figure 2:
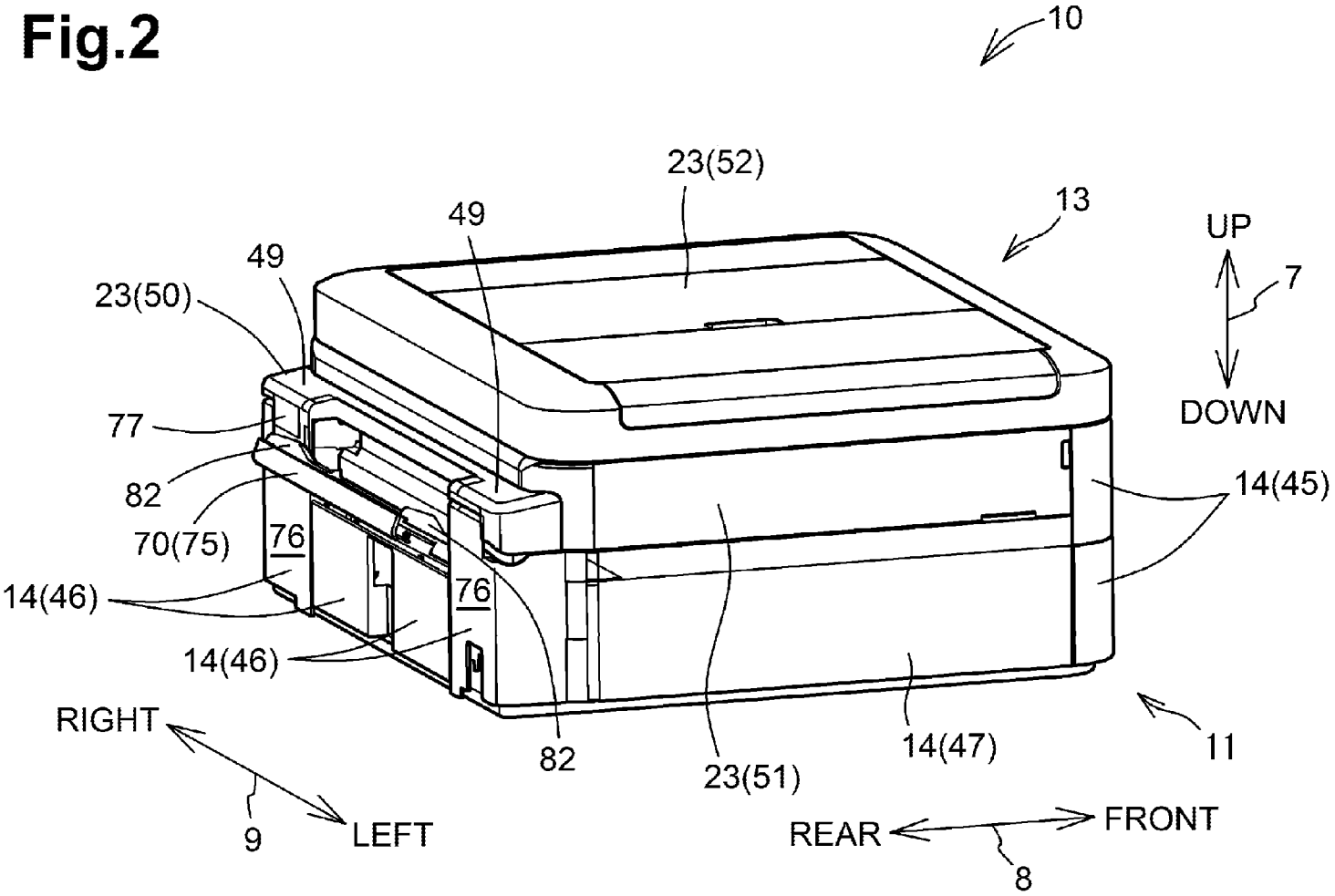
FIG. 2 is a perspective view depicting the multifunction device in the illustrative embodiment according to one or more aspects of the disclosure, wherein the scanner housing is in the first state and the manual feed tray is in a fourth state.

This configuration enables the manual feed tray 70 to pivot on the protrusions 67. More specifically, the manual feed tray 70 is configured to pivot on the protrusions 67 in directions of arrows 94 and 98 (see FIG. 8) to change its state between a third state indicated in FIGS. 1 and 7 and a fourth state indicated in FIGS. 2 and 8.

In the third state, the manual feed tray 70 stands along the rear walls 46 and 50 while a distal end of the manual feed tray 70 is located at a position higher than the rotational axis 53. In the fourth state, the manual feed tray 70 tilts with respect to the rear walls 46 and 50 while the distal end is located at an obliquely upper rear position than a proximal end of the manual feed tray 70. That is, the distal end of the manual feed tray 70 in the fourth state is located at a position further to the rear walls 46 and 50 than the distal end of the manual feed tray 70 in the third state.

Figure 7:
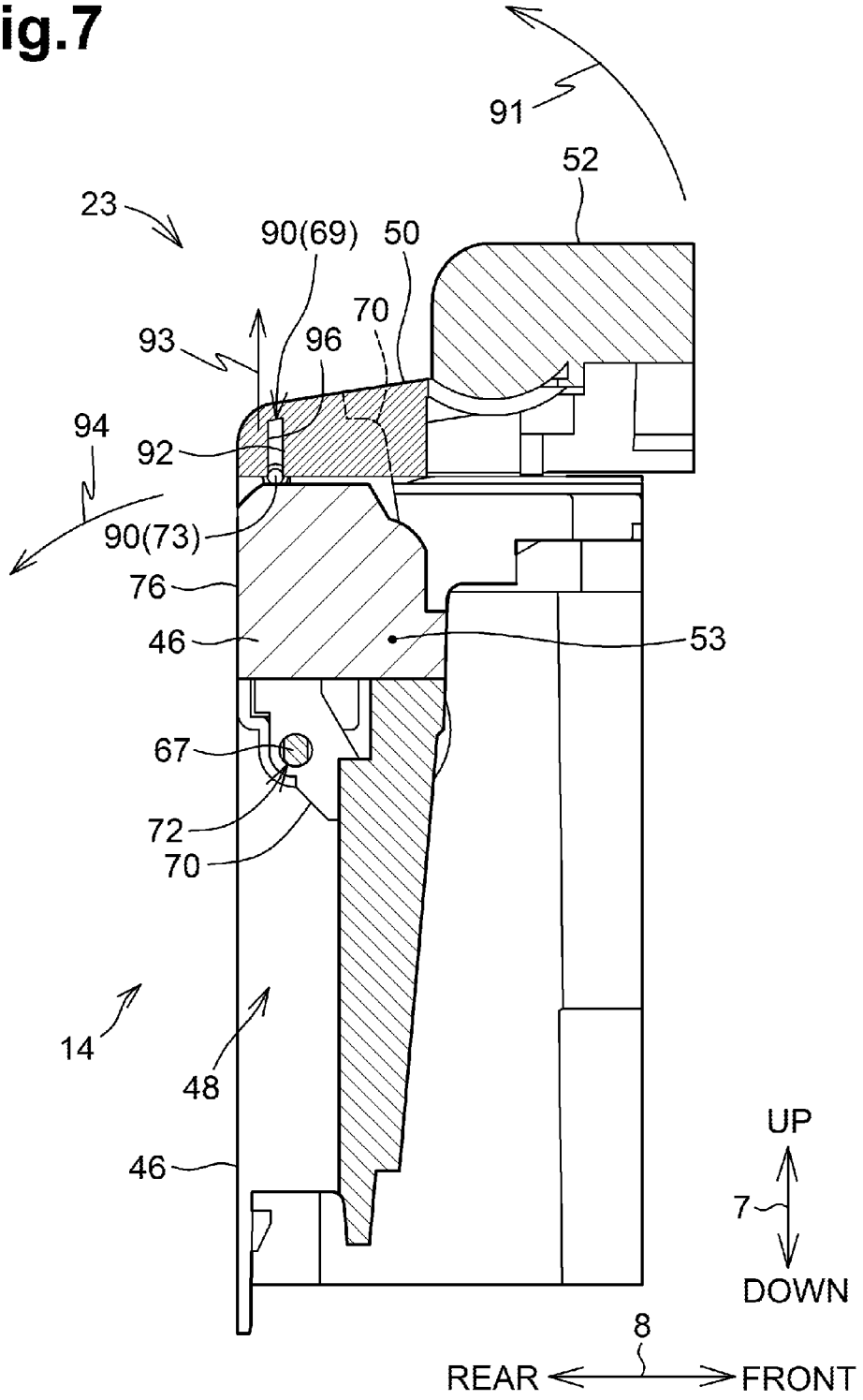
FIG. 7 is a sectional view taken along line A-A of FIG. 6 in the illustrative embodiment according to one or more aspects of the disclosure, wherein the scanner housing is in the first state and the manual feed tray is in the third state.

As depicted in the examples of FIGS. 1, 5, and 7, a lower portion of the manual feed tray 70 in the third state, that is, the proximal end portion of the manual feed tray 70 in the third state, is positioned in the first recessed portion 48 in the printer housing 14. An upper portion of the manual feed tray 70 in the third state, that is, the distal end portion of the manual feed tray 70 in the third state, is positioned in the second recessed portion 55 in the scanner housing 23.

As depicted in the examples of FIGS. 1 and 5, the upper surface 49 of the rear wall 50 of the scanner housing 23 in the first state extends on the same plane as an upper surface 75 of the manual feed tray 70 in the third state extends. A rear surface 76 of the rear wall 46 of the printer housing 14, a rear surface 77 of the rear wall 50 of the scanner housing 23 in the first state, and a rear surface 78 of the manual feed tray 70 in the third state extend on the same plane.

Figure 8:
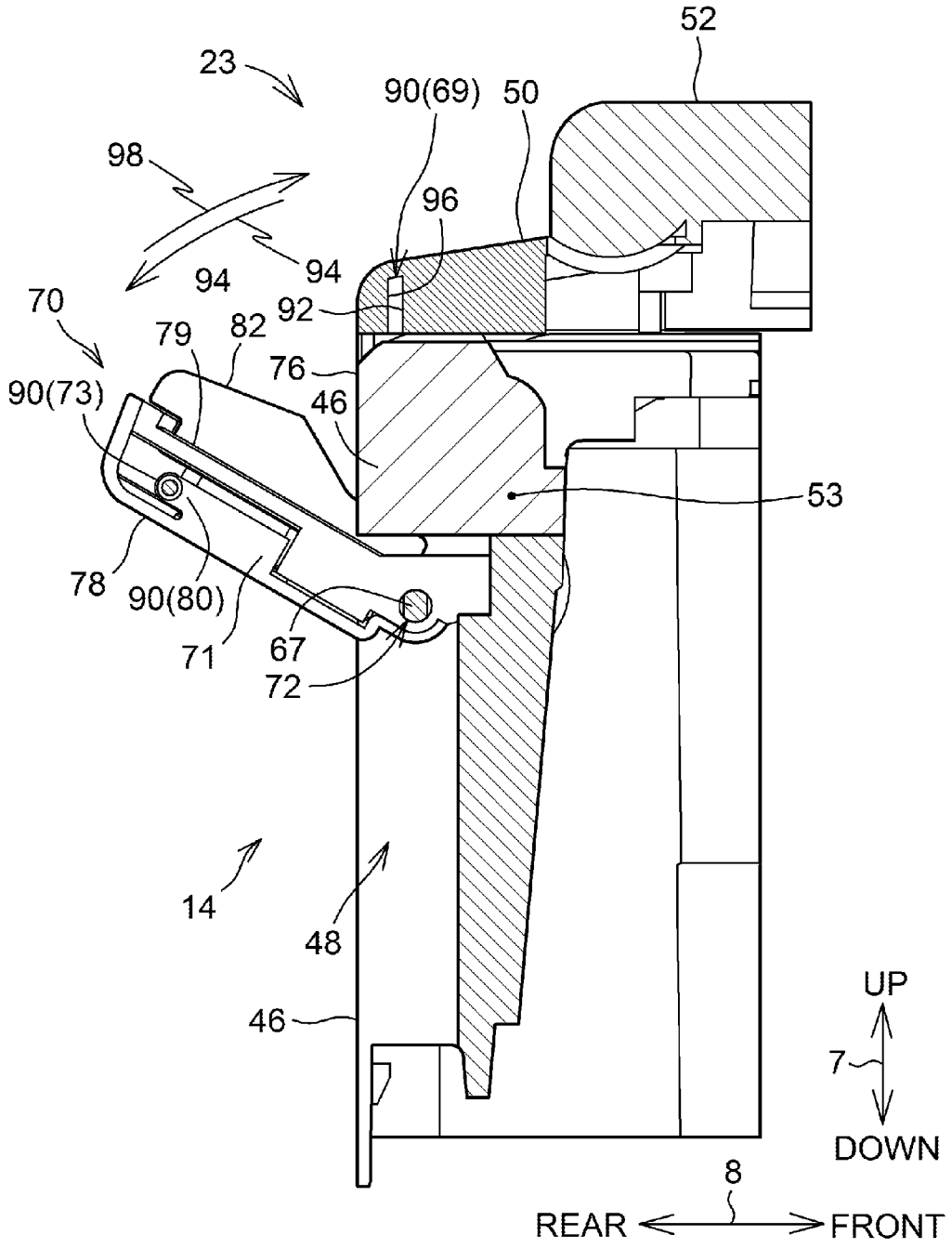
FIG. 8 is a sectional view taken along line A-A of FIG. 6 in the illustrative embodiment according to one or more aspects of the disclosure, wherein the scanner housing is in the first state and the manual feed tray is in the fourth state.

As depicted in the examples of FIGS. 4 and 8, in a state where the manual feed tray 70 is in the fourth state, the manual feed tray 70 is configured to support one or more recording sheets 12 on its front surface 79. The front surface 79 extends to the straight path 34 via clearance 81 that is left between the upper guide member 17 and the front surface 79. As described above, the one or more recording sheets 12 are supported by the front surface 79 while leading edges of the one or more recording sheets 12 are in contact with the conveyor roller pair 59. Side guides 82 are disposed at the front surface 79. The side guides 82 are configured to come into contact with right and left side edges of the one or more recording sheets 12.

[Retainer Portion 90]

As depicted in the examples of FIGS. 5 and 8, the multi-function device 10 includes a retainer portion 90 at each of the right and left portions thereof. The retainer portions 90 enable the manual feed tray 70 to be in one of an engaged state in which the manual feed tray 70 is engaged with the scanner housing 23 and a disengaged state in which the manual feed tray 70 is disengaged from the scanner housing 23. In the illustrative embodiment, each of the retainer portions 90 includes a flexible portion 80 having a flat plate shape, a protrusion 73 (as an example of a protrusion), and the slit 69 (as an example of an engagement portion). The retainer portions 90 have the same configuration, and therefore, a description will be made on one of the retainer portions 90. The flexible portion 80 is disposed at one of the side surfaces 71 of the manual feed tray 70. The protrusion 73 is disposed on the flexible portion 80.

The flexible portion 80 is disposed on the side surface 70 at a position where the flexible portion 80 faces one of the side surfaces 68 of the scanner housing 23 when the manual feed tray 70 is in the third state.

While the flexible portion 80 is integral with the side surface 71 at its one end that is located closer to the center of pivoting of the manual feed tray 70, the other portion of flexible portion 80 is separated from the side surface 71. This configuration enables the flexible portion 80 to warp in the right-left direction 9 at its one end that is located closer to the center of pivoting of the manual feed tray 70, due to elastic deformation. In other embodiments, for example, in the flexible portion 80, a portion of the flexible portion 80 other than its one end that is located closer to the center of pivoting of the manual feed tray 70 may be integral with the side surface 71 if the flexible portion 80 is capable of warping in the right-left direction 9.

The protrusion 73 is integral with the flexible portion 80. The protrusion 73 extends along the right-left direction 9 toward the scanner housing 23 from manual feed tray 7. The protrusion 73 is movable in the right-left direction 9 in accordance with the warping of the flexible portions 80 in the right-left direction 9. That is, the flexible portion 80 moves the protrusion 73 along the right-left direction 9. The protrusion 73 is movable between a protruding position at which the protrusion 73 protrudes from the side surface 71 of the manual feed tray 70 and a retracted position at which the protrusion 73 is positioned an internal space of the manual feed tray 70.

The protrusion 73 at the protruding position is capable of being inserted into the corresponding slit 69 in the side surface 68 of the scanner housing 23. In a state where the protrusion 73 is disposed in the corresponding slit 69, the manual feed tray 70 and the scanner housing 23 are engaged with each other. That is, the manual feed tray 70 is in the engaged state. In the state where the manual feed tray 70 is in the engaged state, the protrusion 73 is engaged in the corresponding slit 69, thereby prohibiting the pivoting of the manual feed tray 70 in the direction of an arrow 94. That is, the slit 69 disables the manual feed tray 70 from pivoting, in engagement with the protrusion 73.

The manual feed tray 70 in the engaged state is retained in the third state when the scanner housing 23 is in the first state. The manual feed tray 70 in the engaged state pivots in the direction of the arrow 94 in accordance with the pivoting of the scanner housing 23 from the position where the scanner housing 23 takes the first state to the position where the scanner housing 23 takes the second state.

As the distal end portion of the manual feed tray 70 is moved rearward by a user while the manual feed tray 70 is in the engaged state, that is, the protrusion 73 is disposed in the slit 69, an end of the protrusion 73 presses a side surface defining the slit 69. Thus, the end of the protrusion 73 receives reaction from the side surface defining the slit 69. Due to the reaction, the flexible portion 80 warps in a direction that the flexible portion 80 moves its protrusion 73 from the protruding position to the retracted position. Thus, the protrusion 73 moves away from the slit 69, thereby being positioned in the internal space of the manual feed tray 70. Therefore, the protrusion 73 is disengaged from the slit 69, whereby the manual feed tray 70 is disengaged from the scanner housing 23. Accordingly, the manual feed tray 70 becomes free to pivot. That is, the flexible portion 80 moved its protrusion 73 away from the slit 69 to bring the manual feed tray 70 into the disengaged state.

During the pivoting of the manual feed tray 70 from the position where the manual feed tray 70 takes the fourth state to the position where the manual feed tray 70 takes the third state, the end of the protrusion 73 presses the rear surface 77 of the rear wall 50 of the scanner housing 23. Thus, the end of the protrusion 73 receives reaction from the rear surface 77. Due to the reaction, the flexible portion 80 warps in a direction that the flexible portion 80 moves its protrusion 73 from the protruding position to the retracted position. Thus, the protrusion 73 moves away from the rear surface 77 and then is positioned in the internal space of the manual feed tray 70. In this state, as the manual feed tray 70 further pivots toward the position where the manual feed tray 70 takes the third state, the protrusion 73 located at the retracted position comes into contact with the side surface 68. Then, as the manual feed tray 70 further pivots toward the position where the manual feed tray 70 takes the third state, the protrusion 73 reaches the slit 69. At that time, force that the warped flexible portion 80 attempts to return to its original state occur. Therefore, the protrusion 73 moves from the retracted position to the protruding position to enter the slit 69. Thus, the protrusion 73 engages in the slit 69, whereby the manual feed tray 70 is engaged with the scanner housing 23. This engagement prevents the manual feed tray 70 from pivoting. That is, the manual feed tray 70 is retained in the third state. As described above, the retainer portion 90 is configured to bring the manual feed tray 70 in the engaged state by moving the protrusion 73 to the position where the protrusion 73 is engaged in the slit 69. The same action described above is taken at each of the retainer portions 90.

In the illustrative embodiment, the end portion of each protrusion 73 includes a convex or curved shape in order to move easily when each protrusion 73 receives the reaction. Nevertheless, in other embodiments, the end shape of each protrusion 73 might not be limited to the convex or curved shape if each protrusion 73 moves easily as described above.

[Interlock Operation of Scanner Housing 23 and Manual Feed Tray 70]

In the state where the manual feed tray 70 is in the engaged state, the retainer portion 90 pivots the manual feed tray 70 toward the position where the manual feed tray 70 takes the fourth state in accordance with the pivoting of the scanner housing 23 from the position where the scanner housing 23 takes the first state to the position where the scanner housing 23 takes the second state. The retainer portion 90 pivots the manual feed tray 70 toward the position where the manual feed tray 70 takes the third state in accordance with the pivoting of the scanner housing 23 from the position where the scanner housing 23 takes the second state to the position where the scanner housing 23 takes the first state.

As depicted in the example of FIG. 7, when the scanner housing 23 is in the first state and the manual feed tray 70 is in the engaged state and in the third state, the protrusions 73 are engaged in lower portions in the slits 69, respectively.

In this state, as the scanner housing 23 pivots toward the position where the scanner housing 23 takes the second state, that is, in the direction of the arrow 91, front surfaces 92 defining the respective slits 69 come into contact with the respective protrusions 73 to guide the protrusions 73 in the direction of an arrow 93 (as an example of a first direction) along the slits 69.

The scanner housing 23 pivots on the rotational axis 53 in a direction of an arrow 91. Thus, the slits 69 move obliquely downward to the rear, that is, downward and rearward, by the pivoting of the scanner housing 23. In accordance with the downward movement of the slits 69, the protrusions 73 slide in the respective slits 69 in the direction of the arrow 93. In accordance with the rearward movement of the slits 69, the protrusions 73 are pressed by the front surfaces 92 defining the slits 69, respectively, and thus move rearward. Therefore, the manual feed tray 70 including the protrusions 73 pivots toward the position where the manual feed tray 70 takes the fourth state, that is, in the direction of the arrow 94. Accordingly, while the scanner housing 23 moves toward the position where the scanner housing 23 takes the second state from the position where the scanner housing 23 takes the first state, as depicted in FIG. 9, the manual feed tray 70 is located at the position closer to the position where the manual feed tray 70 takes the fourth state than the position where the manual feed tray 70 takes the third state.

As described above, the protrusions 73 slide in the direction of the arrow 93 with respect to the slits 69, respectively, in accordance with the pivoting of the scanner housing 23 from the position where the scanner housing 23 takes the first state to the position where the scanner housing 23 takes the second state, to pivot the manual feed tray 70 toward the position where the manual feed tray 70 takes the fourth state. The protrusions 73 are slidable on the respective slits 69 engaged therewith.

In the state depicted in the example of FIG. 9, the protrusions 73 are in engagement with the respective slits 69 at respective positions higher than the positions at which the protrusions 73 are in engagement with the respective slits 69 as depicted in FIG. 7. In this state, as the scanner housing 23 pivots toward the position where the scanner housing 23 takes the first state, that is, in the direction of the arrow 95, rear surfaces 96 defining the respective slits 69 come into contact with the respective protrusions 73 to guide the protrusions 73 along the slits 69 in a direction of an arrow 97 (as an example of a second direction) that is reverse to the direction of the arrow 93.

The scanner housing 23 pivots in the direction of the arrow 95 on the rotational axis 53. Thus, in accordance with the pivoting of the scanner housing 23, the slits 69 move obliquely upward to the front, that is, upward and forward. In accordance with the upward movement of the slits 69, the protrusions 73 slide in the respective slits 69 in the direction of the arrow 97. In accordance with the forward movement of the slits 69, the protrusions 73 are pressed by the rear surfaces 96 of the slits 69, respectively, to move forward. Thus, the manual feed tray 70 equipped with the protrusions 73 pivots toward the position where the manual feed tray 70 takes the third state, that is, in the direction of the arrow 98. Accordingly, when the scanner housing 23 becomes in the first state from the second state, as depicted in FIG. 7, the manual feed tray 70 is in the third state.

As described above, the protrusions 73 slide in the respective slits 69 in the direction of the arrow 97 to pivot the manual feed tray 70 toward the position where the manual feed tray 70 takes the third state, in accordance with the pivoting of the scanner housing 23 from the position where the scanner housing 23 takes the second state to the position where the scanner housing 23 takes the first state.

[Effects of Illustrative Embodiment]

According to the illustrative embodiment, in accordance with the changing of the scanner housing 23 from the first state to the second state while the manual feed tray 70 is in the third state, the manual feed tray 70 pivots toward the position where the manual feed tray 70 takes the fourth state. This configuration may prevent the manual feed tray 70 from interfering with the pivoting of the scanner housing 23 to the position where the scanner housing 23 takes the second state even when the pivotable range of the scanner housing 23 overlaps the pivotable range of the manual feed tray 70. In accordance with the changing of the scanner housing 23 from the second state to the first state, the manual feed tray 70 pivots toward the position where the manual feed tray 70 takes the third state. Thus, the manual feed tray 70 in the fourth state becomes enabled to pivot toward the position where the manual feed tray 70 takes the third state.

According to the illustrative embodiment, while the scanner housing 23 changes from the first state to the second state when the manual feed tray 70 is in the third state, the protrusions 73 slide in the respective slits 69 in the direction of the arrow 93 to pivot the manual feed tray 70 toward the position where the manual feed tray 70 takes the fourth state. While the scanner housing 23 changes from the second state to the first state, the protrusions 73 slide in the respective slits 69 in the direction of the arrow 97 to pivot the manual feed tray 70 toward the position where the manual feed tray 70 takes the third state.

According to the illustrative embodiment, the state of the manual feed tray 70 can be changed between the engaged state and the disengaged state by moving the protrusions 73. Therefore, the configuration for changing the manual feed tray 70 between the engaged state and the disengaged state may be implemented by the simple configuration.

According to the illustrative embodiment, the second recessed portion 55 extends to the upper surface 49 of the scanner housing 23. Therefore, the user may easily access the manual feed tray 70 in the third state disposed at the rear portion of the multifunction device 10 from the upper front of the multifunction device 10. Accordingly, the user may pivot the manual feed tray 70 easily from the front of the multifunction device 10. According to the illustrative embodiment, the manual feed tray 70 in the third state can be accommodated in the first recessed portion 48 and the second recessed portion 55. Therefore, the multifunction device 10 may be reduced in size.

According to the illustrative embodiment, the upper surface 49 of the scanner housing 23 in the first state is flush with the upper surface 75 of the manual feed tray 70 in the third state, thereby improving an appearance of the multifunction device 10.

According to the illustrative embodiment, the rear surface 76 of the rear wall 46 of the printer housing 14, the rear surface 77 of the rear wall 50 of the scanner housing 23 in the first state, and the rear surface 78 of the manual feed tray 70 in the third state are flush with each other, thereby improving the appearance of the multifunction device 10.

According to the illustrative embodiment, the manual feed tray 70 is disposed at the higher position than the straight path 34. This configuration may avoid or reduce a risk of the contact between the manual feed tray 70 and a recording medium having a thickness thicker than a recording sheet 12.

According to the illustrative embodiment, in the configuration including the reading mechanism that is relatively frequently used, the manual feed tray 70 may be disposed within the pivotable range of the scanner housing 23.

[Variations]

In the illustrative embodiment, the slits 69 are defined in the respective side surfaces 68 defining the second recessed portion 55, and the protrusions 73 and the flexible portions 80 are disposed at the respective side surfaces 71 of the manual feed tray 70. Nevertheless, in other embodiments, for example, the slits 69 may be defined in the respective side surfaces 71 and the protrusions 73 and the flexible portions 80 may be disposed at the respective side surfaces 68. That is, the protrusions 73 may be disposed at one of the manual feed tray 70 and the scanner housing 23 and the slits 69 may be defined in the other of the manual feed tray 70 and the scanner housing 23.

In the illustrative embodiment, each of the retainer portions 90 includes the flexible portion 80 that moves the protrusion 73 elastically. Nevertheless, in other embodiments, for example, the protrusion 73 may be moved by another manner other than using the flexible portion 80. For example, the retainer portions 90 may be connected with the respective protrusions 67 and include a lever portion configured to move the protrusions 67 between the protruding position and the retracted position in response to the user's operation. In accordance with the position change of the protrusions 67 to the protruding position in response to the user's operation of the lever portion, the manual feed tray 70 may become in the engaged state. In accordance with the position change of the protrusions 67 to the retracted position in response to the user's operation of the lever portion, the manual feed tray 70 may become in the disengaged state.

In the illustrative embodiment, each of the retainer portions 90 includes the protrusion 73 and the slit 69. Nevertheless, in other embodiments, the configuration of the retainer portions 90 might not be limited to the above-described configuration. For example, each of the retainer portions 90 may have a first opening and a second opening and include a link mechanism. The first opening may be defined in the side surface 71 of the manual feed tray 70. The second opening may be defined in the side surface 68 of the scanner housing 23. The link mechanism may include a first protrusion at one end portion and a second protrusion at the other end portion. The first protrusion and the second protrusion may be configured to enter the first opening and the second opening, respectively. In this case, in accordance with the pivoting of the scanner housing 23 from the position where the scanner housing 23 takes the first state to the position where the scanner housing 23 takes the second state, the manual feed tray 70 may pivot toward the position where the manual feed tray 70 takes the fourth state via the link mechanism. In accordance with the pivoting of the scanner housing 23 from the position where the scanner housing 23 takes the second state to the position where the scanner housing 23 takes the first state, the manual feed tray 70 may pivot toward the position where the manual feed tray 70 takes the third state via the link mechanism.

In the illustrative embodiment, the slits 69 extends in the up-down direction 7 when the scanner housing 23 is in the first state. Nevertheless, the direction that the slits 69 extends might not be limited to the up-down direction 7 if the slits 69 enable the above-described interlocking operation of the scanner housing 23 and the manual feed tray 70. In other embodiments, for example, the slits 69 may extend in an inclined direction with respect to the up-down direction 7 when the scanner housing 23 is in the first state.

In the illustrative embodiment, the second housing is the scanner housing including the reading mechanism. Nevertheless, in other embodiments, for example, the second housing might not be required to include the reading mechanism. For example, the second housing may be an upper cover configured to pivot between a position where the upper cover covers the upper portion of the printer housing 14 and a position where the upper cover exposes the upper portion of the printer housing 14. When a recording sheet 12 jams in the multifunction device 10, the upper cover may be configured to pivot from the position where the upper cover covers the upper portion of the printer housing 14 and the position where the upper cover exposes the upper portion of the printer housing 14.

In the illustrative embodiment, for recording an image on a recording medium, the medium tray 110 supporting the recording medium is inserted into the printer housing 14. Nevertheless, in other embodiments, for example, the recording medium may be directly inserted into the printer housing 14 without the medium tray 110 and an image may be recorded on the recording medium.

In the illustrative embodiment, the printer housing 14 has the first recessed portion 48 configured to accommodate the lower portion of the manual feed tray 70 and the scanner housing 23 has the second recessed portion 55 configured to accommodate the upper portion of the manual feed tray 70. Nevertheless, in other embodiments, for example, the printer housing 14 might not necessarily be required to have the first recessed portion 48 and the second recessed portion 55.

What is claimed is:

1. An image recording device comprising:

a first housing having a sheet conveyance path;

a second housing disposed above the first housing to pivot about a first pivot axis, the second housing being movable between a first state in which a lower surface of the second housing is generally adjacent to an upper surface of the first housing and a second state in which the lower surface of the second housing is angled relative to the upper surface of the first housing;

a support tray adjacent to a first side of the second housing and a first side of the first housing and pivotably connected to the first housing, the support tray being movable between a third state and a fourth state, the support tray communicating with the sheet conveyance path; and a retainer portion connecting the support tray to the second housing in the first state and the second state.

2. The image recording device according to claim 1, wherein the support tray pivots about a second pivot axis that extends in parallel to the first pivot axis, and wherein the second pivot axis is located lower than the first pivot axis.

3. The image recording device according to claim 1, wherein the retainer portion comprises:

a first engagement portion on the support tray; and a second engagement portion on the second housing to selectively engage the first engagement portion. so as to restrict the support tray from pivoting.

4. The image recording device according to claim 3, wherein the first engagement portion slides in a first direction with respect to the second engagement portion to pivot the support tray toward the fourth state, in response to a state change of the second housing from the first state to the second state; and wherein the first engagement portion slides in a second direction opposite to the first direction with respect to the second engagement portion to pivot the support tray toward the third state in response to a state change of the second housing from the second state to the first state.

5. The image recording device according to claim 4, wherein the first engagement portion is a protrusion and the second engagement portion is a slit.

6. The image recording device according to claim 3, wherein the first engagement portion is movable between a position where the first engagement portion is in engagement with the second engagement portion and a position where the first engagement portion is spaced apart from the second engagement portion.

7. The image recording device according to claim 3, wherein the first housing further comprises a first accommodation portion for receiving a first portion of the support tray in the third state;

wherein the second housing further comprises a second accommodation portion for receiving a second portion of the support tray in the third state;

wherein the first accommodation portion is defined by a wall surface;

wherein the second engagement portion is disposed at the wall surface, and wherein the first engagement portion is disposed at the support tray.

8. The image recording device according to claim 1, wherein in the third state, a first end portion of the support tray overlaps the first housing, and wherein in the third state, a second end portion of the support tray overlaps the second housing.

9. The image recording device according to claim 1, wherein an upper surface of the second housing and an upper surface of the support tray extends along a common a plane when the second housing is in the first state and the support tray is in the third state.

10. The image recording device according to claim 1, wherein a surface of the first housing, a surface of the second housing, and a surface of the support tray extend along a common plane when the second housing is in the first state and the support tray is in the third state.

11. The image recording device according to claim 1, wherein the first housing further has a path for passing a tray that supports a recording medium, and wherein the support tray is positioned above the path.

12. The image recording device according to claim 1, wherein the second housing further comprises a reading mechanism.

13. The image recording device according to claim 1, wherein the first housing further comprises:

a conveyor configured to convey the recording medium in a conveyance direction, a feed tray configured to support the recording medium, and a feed roller configured to feed the recording medium supported by the feed tray toward the conveyor along the conveyance path, and wherein the support tray comprises a support surface that extends toward the conveyance path via an opening.

* * * * *